US011355295B2

(12) United States Patent
Doro

(10) Patent No.: US 11,355,295 B2
(45) Date of Patent: Jun. 7, 2022

(54) PUSH SWITCH

(71) Applicant: Panasonic Intellectual Property Management Co., Ltd., Osaka (JP)

(72) Inventor: Kunio Doro, Okayama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/280,368

(22) PCT Filed: Jul. 25, 2019

(86) PCT No.: PCT/JP2019/029130
§ 371 (c)(1),
(2) Date: Mar. 26, 2021

(87) PCT Pub. No.: WO2020/090167
PCT Pub. Date: May 7, 2020

(65) Prior Publication Data

US 2021/0383987 A1 Dec. 9, 2021

(30) Foreign Application Priority Data

Oct. 31, 2018 (JP) ..... JP2018-206117

(51) Int. Cl.
*H01H 13/14* (2006.01)
*H01H 13/06* (2006.01)
(Continued)

(52) U.S. Cl.
CPC ..... *H01H 13/14* (2013.01); *H01H 13/06* (2013.01); *H01H 13/10* (2013.01); *H01H 13/52* (2013.01); *H01H 2223/044* (2013.01)

(58) Field of Classification Search
CPC ..... H01H 13/14; H01H 13/06; H01H 13/10; H01H 13/52; H01H 2223/044;
(Continued)

(56) References Cited

U.S. PATENT DOCUMENTS 6,561,971 B1 * 5/2003 Akiba ..... A61B 1/00188 600/131
9,536,687 B2 * 1/2017 Takeuchi ..... H01H 13/04
(Continued)

FOREIGN PATENT DOCUMENTS

JP 2013-058380 3/2013
WO 2017/065003 4/2017

OTHER PUBLICATIONS

International Search Report of PCT application No. PCT/JP2019/029130 dated Oct. 8, 2019.

*Primary Examiner* — Lheiren Mae A Caroc
(74) *Attorney, Agent, or Firm* — McDermott Will & Emery LLP

(57) ABSTRACT

A push switch includes: a case including a recess; a fixed contact member including a fixed contact disposed in the recess; a movable contact member including a movable contact disposed in the recess; a protective sheet disposed in a first direction from the recess and covering the recess; and a rib disposed on the protective sheet. The protective sheet includes: a pressing portion; a fixed portion fixed to the case; and an intermediate portion located between the pressing portion and the fixed portion as viewed in the first direction. As the pressing portion of the protective sheet is pressed along the first direction, the movable contact member deforms by force received from the protective sheet. The movable contact touches the fixed contact as a result of the deformation of the movable contact member.

20 Claims, 10 Drawing Sheets

(51) Int. Cl.
*H01H 13/10* (2006.01)
*H01H 13/52* (2006.01)

(58) Field of Classification Search
CPC ..... H01H 13/04; H01H 13/12; H01H 13/22; H01H 13/26; H01H 13/36; H01H 13/48; H01H 13/50; H01H 5/30
See application file for complete search history.

(56) References Cited

U.S. PATENT DOCUMENTS

| | | | | |
|---|---|---|---|---|
| 2013/0062170 | A1 | 3/2013 | Takeuchi et al. | |
| 2014/0311882 | A1* | 10/2014 | Terashita ..... | H01H 13/14 200/520 |
| 2018/0218854 | A1 | 8/2018 | Miyamoto | |

* cited by examiner

PUSH SWITCH

CROSS-REFERENCE TO RELATED APPLICATIONS

This application is a U.S. national stage application of the PCT International Application No. PCT/JP2019/029130 filed on Jul. 25, 2019, which claims the benefit of foreign priority of Japanese patent application No. 2018-206117 filed on Oct. 31, 2018, the contents all of which are incorporated herein by reference.

TECHNICAL FIELD

The present disclosure relates to push switches.

BACKGROUND ART

Patent Literature (PTL) 1 discloses a push switch. In this push switch, a center contract and an outer contact are fixed to the inner bottom surface of a recess formed by being surrounded by a wall of a case. A dome-shaped movable contact is disposed in the recess. The lower end of the outer periphery of the movable contact is mounted on the outer contact. The lower surface of a center portion of the movable contact faces the center contact with spacing therebetween. A rectangular protective sheet is provided over the case so as to cover the recess. A peripheral edge portion of the protective sheet is welded to the upper end of the wall of the case. A pressing body is fixedly attached to the lower surface of the protective sheet. The lower surface of the pressing body is mounted on a central vertex portion of the movable contact.

When pressing force is applied to a center portion of the protective sheet and the movable contact is pressed by the pressing body, this push switch enters into an ON state where the movable contact is in contact with the center contact. Furthermore, when the pressing force is removed, the movable contact elastically returns to an original shape, and thus the push switch is placed back into an OFF state where the center contact and the outer contact are not electrically connected to each other.

CITATION LIST

Patent Literature

PTL 1: Unexamined Japanese Patent Publication No. 2013-058380

SUMMARY OF THE INVENTION

A push switch according to one aspect of the present disclosure includes: a case configured to include a recess; a fixed contact member configured to include a fixed contact disposed in the recess; a movable contact member configured to include a movable contact disposed in the recess; a protective sheet disposed in a first direction from the recess and configured to cover the recess; and a rib disposed on the protective sheet. The protective sheet includes: a pressing portion; a fixed portion fixed to the case; and an intermediate portion located between the pressing portion and the fixed portion as viewed in the first direction. As the pressing portion of the protective sheet is pressed along the first direction, the movable contact member deforms by force received from the protective sheet. The movable contact touches the fixed contact as a result of the deformation of the movable contact member.

DESCRIPTION OF EMBODIMENT (1) Outline

The exemplary embodiment described below relates to a push switch and more particularly relates to a push switch including a protective sheet covering a fixed contact and a movable contact.

Figure 1:
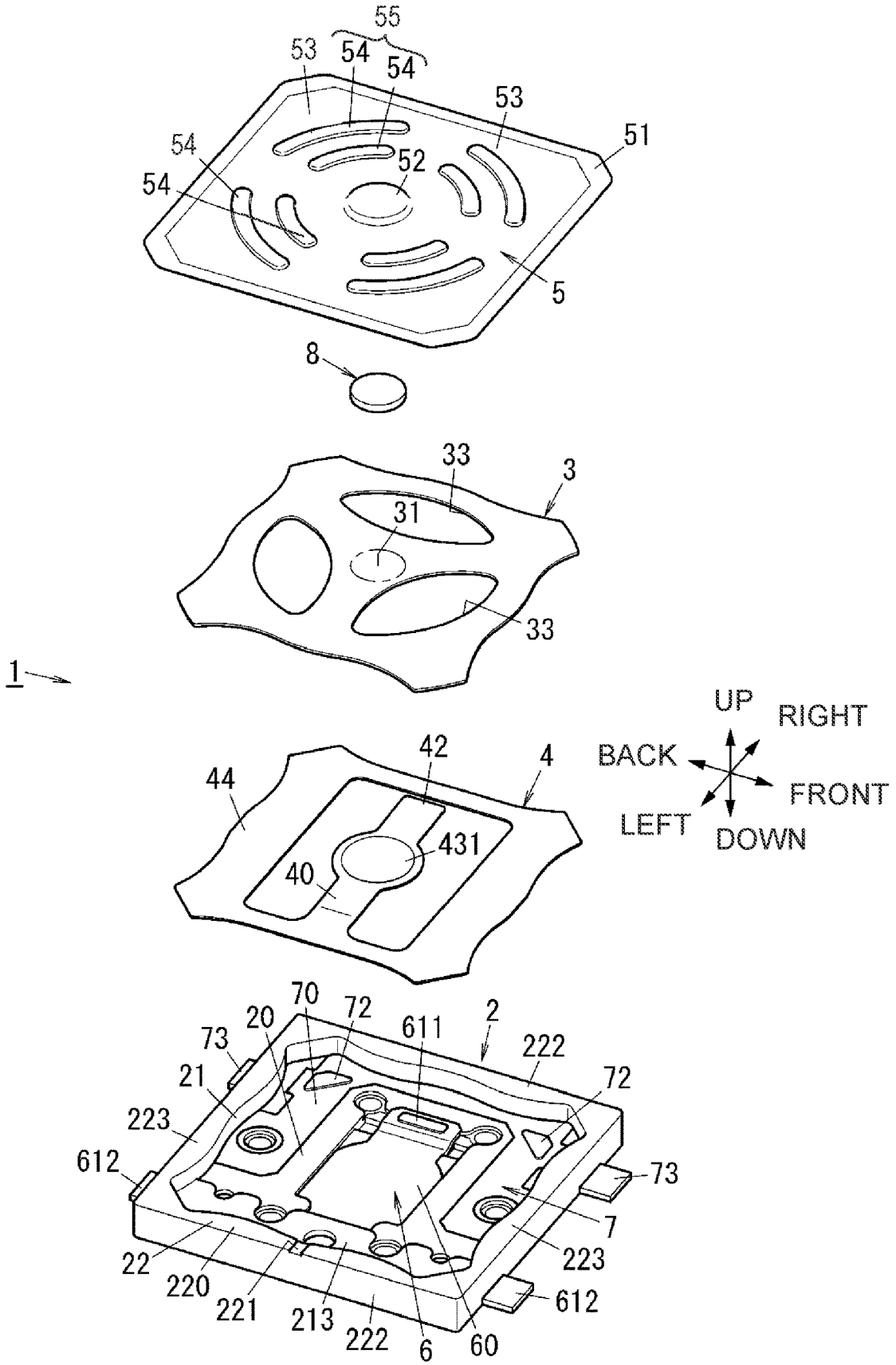
FIG. 1 is an exploded perspective view of a push switch according to an exemplary embodiment of the present invention.
Figure 2:
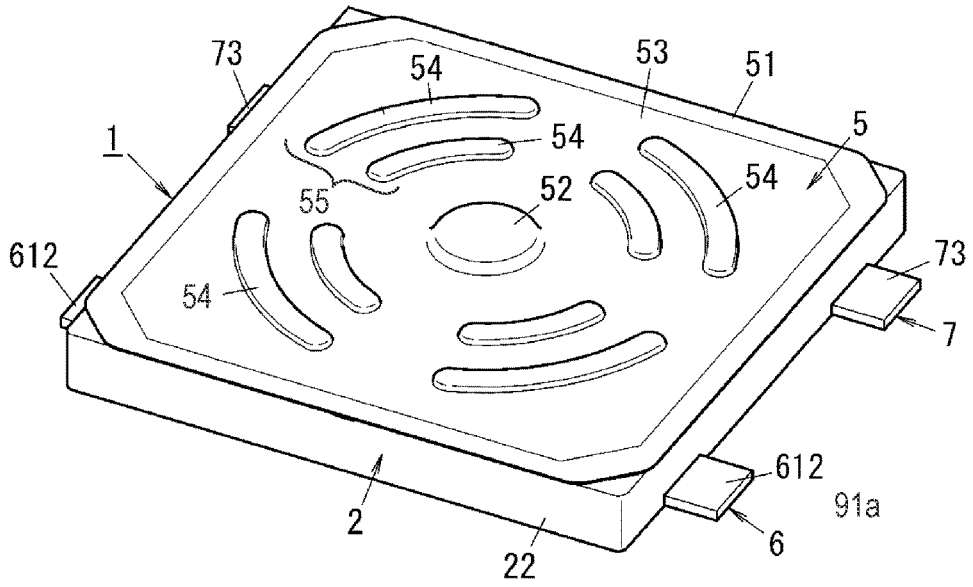
FIG. 2 is a perspective view of a push switch according to an exemplary embodiment of the present invention.

As illustrated in FIG. 1 and FIG. 2, push switch 1 according to the present exemplary embodiment includes case 2, fixed contact member 6, movable contact member 4, and protective sheet 5. Case 2 includes recess 21. Fixed contact member 6 includes first fixed contact 611. Fixed contact 611 is disposed in recess 21. Movable contact member 4 includes movable contact 42. Movable contact 42 is disposed in recess 21. Protective sheet 5 covers recess 21.

Protective sheet 5 includes fixed portion 51, pressing portion 52, and intermediate portion 53. Fixed portion 51 is fixed to case 2. Intermediate portion 53 connects pressing portion 52 and fixed portion 51 to each other. By receiving force from protective sheet 5 with pressing portion 52 pressed down, movable contact member 4 deforms so as to change the state of movable contact 42 between touching and not touching first fixed contact 611. Protective sheet 5 further includes at least one rib 54. At least one rib 54 is formed on intermediate portion 53.

In push switch 1 according to the present exemplary embodiment, it is possible to reduce the spring constant by increasing the rigidity of intermediate portion 53 of protective sheet 5 in an area where rib 54 is formed. Therefore, it is possible to adjust the natural frequency of protective sheet 5 by changing the position, size, shape, etc., of rib 54. This allows a reduction in the production of sound having an unintended frequency from protective sheet 5 when push switch 1 is operated.

(2) Details

Push switch 1 according to the present exemplary embodiment is used as an operation unit of various devices such as information devices and home appliances. For example, push switch 1 is mounted on a printed board and in this state is embedded in the housing of a device. In this case, pressing element 90 (refer to FIG. 3) in the form of an operation button or the like, for example, is disposed on the housing, at a position corresponding to push switch 1, and when a user presses pressing element 90, push switch 1 is indirectly operated via pressing element 90.

In the subsequent description, unless otherwise stated, push switch 1 that is not being pressed or operated will be described. Each element of push switch 1 will be described below using the directions shown in FIG. 1. Specifically, the thickness direction of protective sheet 5 is defined as upward and downward directions, the directions orthogonal to the upward and downward directions are defined as forward and backward directions, and the directions orthogonal to both the upward and downward directions and the forward and backward directions are defined as left and right directions. Among the upward and downward directions, a direction in which recess 21 is open is defined as upward. Note that the directions used in the present disclosure do not represent the directions of push switch 1 in use.

As illustrated in FIG. 1, push switch 1 according to the present exemplary embodiment includes case 2, fixed contact member 6, terminal 7, movable contact member 4, movable member 3, pressing body 8, and protective sheet 5.

Case 2 is made from synthetic resin and has electrical insulating properties. Case 2 is formed in the shape of a cuboid whose thickness direction is parallel to the upward and downward directions. Specifically, case 2 includes bottom 20 and peripheral wall 22 projecting upward (in the direction from the bottom surface of recess 21 toward protective sheet 5) from the outer rim of bottom 20.

Bottom 20 according to the present exemplary embodiment is formed in the shape of a rectangle (specifically, a square) as viewed from above. Peripheral wall 22 is formed in the shape of a rectangular frame (specifically, a square frame) as viewed from above. Peripheral wall 22 includes a pair of left and right walls 222 that oppose each other and a pair of front and rear walls 223 that oppose each other.

Note that the "shape of a rectangle" in the present disclosure includes not only the shape of a rectangle in a strict sense with all four angles equal in measure, but also a shape that is similar to the rectangle and can be regarded as an approximate rectangular shape. Similarly, the "shape of a square" includes not only the shape of a square in a strict sense with all four sides equal in length and all four angles equal in measure, but also a shape that is similar to the square and can be regarded as an approximate square shape.

In case 2, recess 21 that is open upward is formed. Recess 21 is the space surrounded by bottom 20 and peripheral wall 22. The upper surface of bottom 20 constitutes the bottom surface of recess 21. The inner peripheral surface of peripheral wall 22 constitutes the inner peripheral surface of recess 21. Recess 21 according to the present exemplary embodiment is formed in the shape of a rectangle (specifically, a square) as viewed from above. As viewed from above, the inner peripheral surface of peripheral wall 22 is curved by projecting outward in a central area of each side of recess 21 and projecting outward in the four corner parts thereof.

Figure 4:
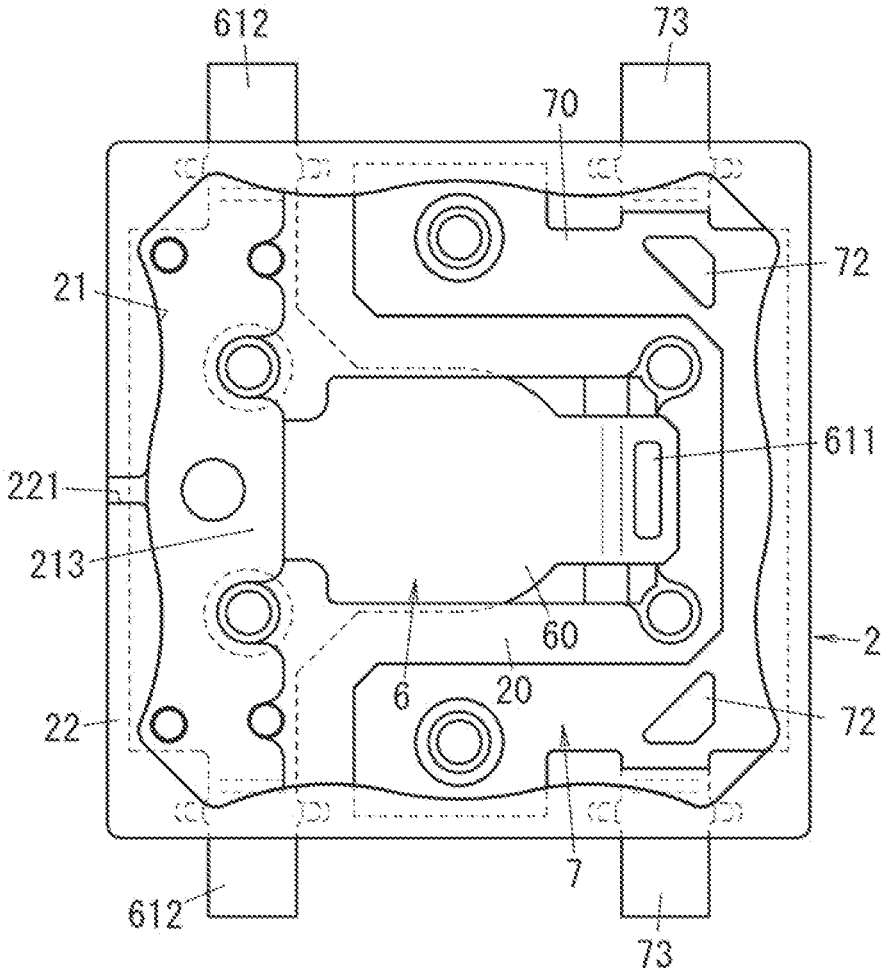
FIG. 4 is a plan view of a push switch according to an exemplary embodiment of the present invention with a protective sheet, a pressing body, a movable member, and a movable contact member removed.

As illustrated in FIG. 1 and FIG. 4, case 2 holds fixed contact member 6 and terminal 7. Each of fixed contact member 6 and terminal 7 is formed from an electrically conductive metal plate. Each of fixed contact member 6 and terminal 7 is held on case 2 by being at least partially embedded in case 2. Case 2, fixed contact member 6, and terminal 7 are formed, for example, by insert molding. In this case, fixed contact member 6 and terminal 7, which are insert parts, are integrated with case 2, which is made from synthetic resin, and thus are held on case 2.

Fixed contact member 6 according to the present exemplary embodiment includes fixed contact 611 and a pair of terminal portions 612. Hereinafter, fixed contact 611 will be referred to as first fixed contact 611, and terminal portion 612 will be referred to as first terminal portion 612.

Fixed contact member 6 includes embedded portion 60 which is embedded in bottom 20. The upper surface of embedded portion 60 is exposed on recess 21. First fixed contact 611 is formed on the upper surface of embedded portion 60 and protrudes more upward than the other area in embedded portion 60. First fixed contact 611 is located in the middle area of recess 21 in the forward and backward directions.

One of the pair of first terminal portions 612 protrudes toward the outside of case 2 from the front face of case 2, and the other of the pair of first terminal portions 612 protrudes toward the outside of case 2 from the back face of case 2. The pair of first terminal portions 612 are electrically connected to first fixed contact 611. As a result of including the pair of terminal portions 612, fixed contact member 6 according to the present exemplary embodiment functions as a terminal separate from terminal 7.

Terminal 7 according to the present exemplary embodiment is disposed to the right of fixed contact member 6. Fixed contact member 6 and terminal 7 are electrically insulated from each other. Terminal 7 according to the present exemplary embodiment includes a pair of fixed contacts 72 and a pair of terminal portions 73. Hereinafter, fixed contact 72 will be referred to as second fixed contact 72, and terminal portion 73 will be referred to as second terminal portion 73.

Terminal 7 includes embedded portion 70 which is embedded in bottom 20. The upper surface of embedded portion 70 is exposed on recess 21. The pair of second fixed contacts 72 are formed on the upper surface of embedded portion 70 and protrude upward. The pair of second fixed contacts 72 are located at both ends of recess 21 in the forward and backward directions. The upper surface of each of second fixed contacts 72 is located at the same position as the upper surface of first fixed contact 611 in the upward and downward directions.

One of the pair of second terminal portions 73 protrudes toward the outside of case 2 from the front face of case 2, and the other of the pair of second terminal portions 73 protrudes toward the outside of case 2 from the back face of case 2. The pair of second terminal portions 73 are electrically connected to the pair of second fixed contacts 72. Each of the pair of first terminal portions 612 and the pair of second terminal portions 73 is bonded to an electrically conductive member on the printed board by soldering, for example.

Bottom 20 of case 2 includes pedestal 213. Pedestal 213 is formed on the upper surface of bottom 20 and protrudes upward. The upper surface of pedestal 213 is located at the same position as the upper surface of first fixed contact 611 in the upward and downward directions.

Figure 5A:
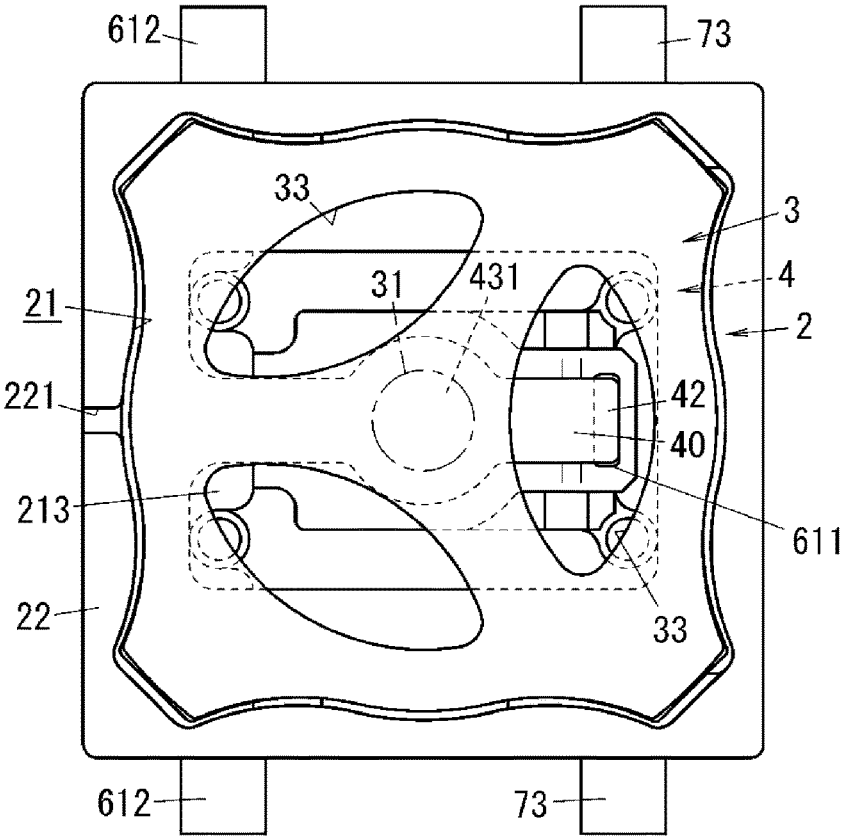
FIG. 5A is a plan view of a push switch according to an exemplary embodiment of the present invention with a protective sheet and a pressing body removed.
Figure 5B:
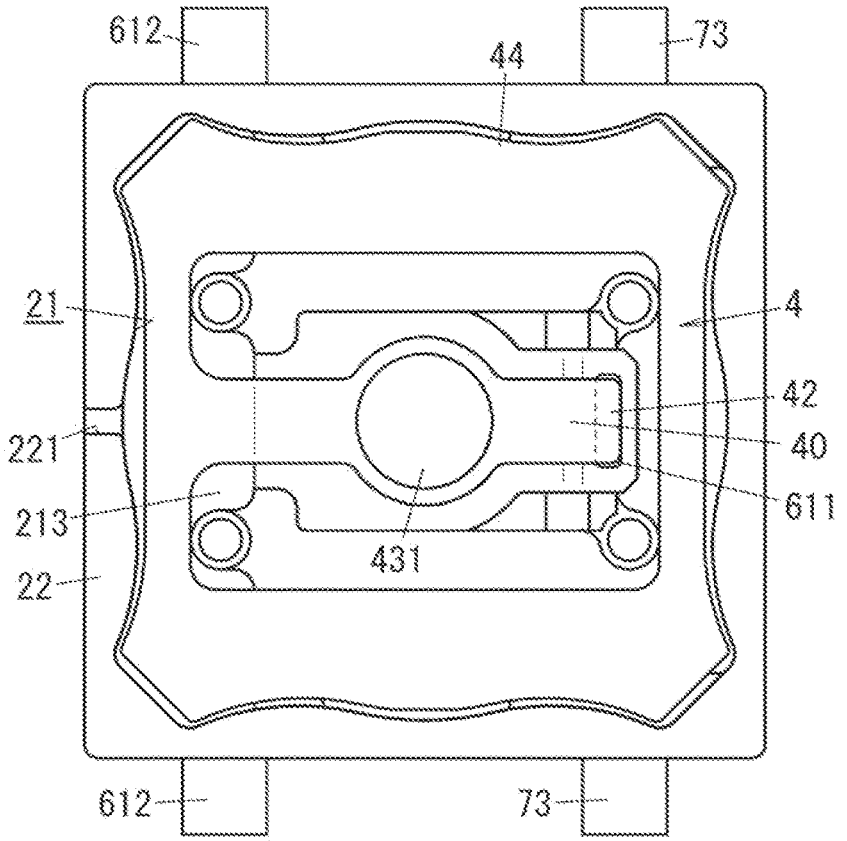
FIG. 5B is a plan view of a push switch according to an exemplary embodiment of the present invention with a protective sheet, a pressing body, and a movable member removed.

Movable contact member 4 illustrated in FIG. 1 and FIG. 5B is disposed in recess 21 of case 2. For example, movable contact member 4 is formed from a metal plate and has elasticity and electrical conductivity. Movable contact member 4 according to the present exemplary embodiment includes supporting frame 44 and touching piece 40. Supporting frame 44 is formed in the shape of a rectangular frame (specifically, a square frame) as viewed from above. The lower surface of supporting frame 44 is in contact with each of the upper surface of pedestal 213 and the upper surfaces of second fixed contacts 72. Thus, movable contact member 4 is electrically connected to two second fixed contacts 72.

The outer rim of supporting frame 44 has a shape that matches the inner peripheral surface of peripheral wall 22 of case 2 as viewed from above. The outer rim of supporting frame 44 is disposed along the inner peripheral surface of peripheral wall 22. With this, movement of supporting frame 44 in a direction (horizontal direction) intersecting the upward and downward directions is restricted.

Touching piece 40 is disposed on the inner side of supporting frame 44. Touching piece 40 protrudes from a left end of supporting frame 44, which constitutes one side of supporting frame 44, toward the inside of supporting frame 44 (rightward). Touching piece 40 is supported in the form of a cantilever by supporting frame 44, and the tip of touching piece 40 is a free end. The proximal end (left end) of touching piece 40 is in contact with the upper surface of pedestal 213. In the present exemplary embodiment, the tip (right end) of touching piece 40 constitutes movable contact 42.

Movable contact member 4 includes pressure-receiving portion 431 which receives operation force upon operation of push switch 1. Here, the "operation force" is force applied by a user to push switch 1 from the outside of push switch 1 upon operation of push switch 1. Hereinafter, pressure-receiving portion 431 will be referred to as first pressure-receiving portion 431.

First pressure-receiving portion 431 according to the present exemplary embodiment is formed in the middle area of touching piece 40 in the left and right directions and protrudes upward. First pressure-receiving portion 431 is formed in the shape of a circle as viewed from above.

Figure 6A:
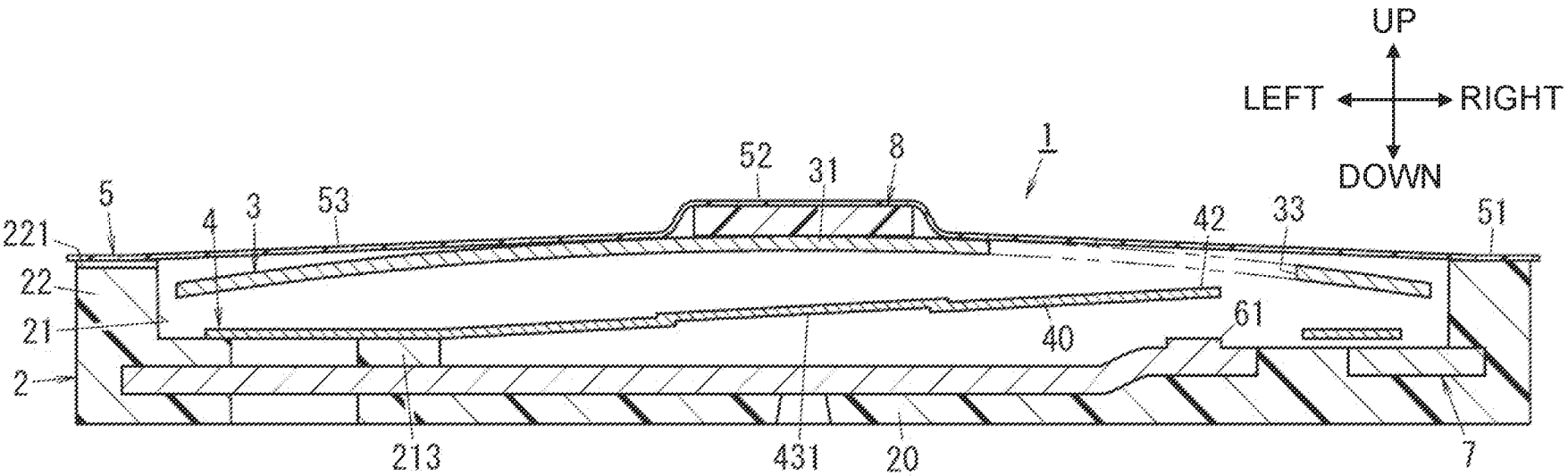
FIG. 6A is a cross-sectional view of a push switch according to an exemplary embodiment of the present invention that is not being operated, taken along line X1-X1 in FIG. 3.

In the state illustrated in FIG. 6A where push switch 1 is not being operated, there is no operation force applied to first pressure-receiving portion 431. At this time, a portion located on the tip side (right side) relative to the proximal end of touching piece 40 extends so that a portion closer to the tip of touching piece 40 is located at a higher level, and movable contact 42 is located above first fixed contact 611 with spacing therebetween. Therefore, push switch 1 is in an OFF state where movable contact member 4 and fixed contact member 6 are not electrically connected. In other words, push switch 1 according to the present exemplary embodiment is a normally-open switch which is in the OFF state when push switch 1 is not being operated.

Figure 6B:
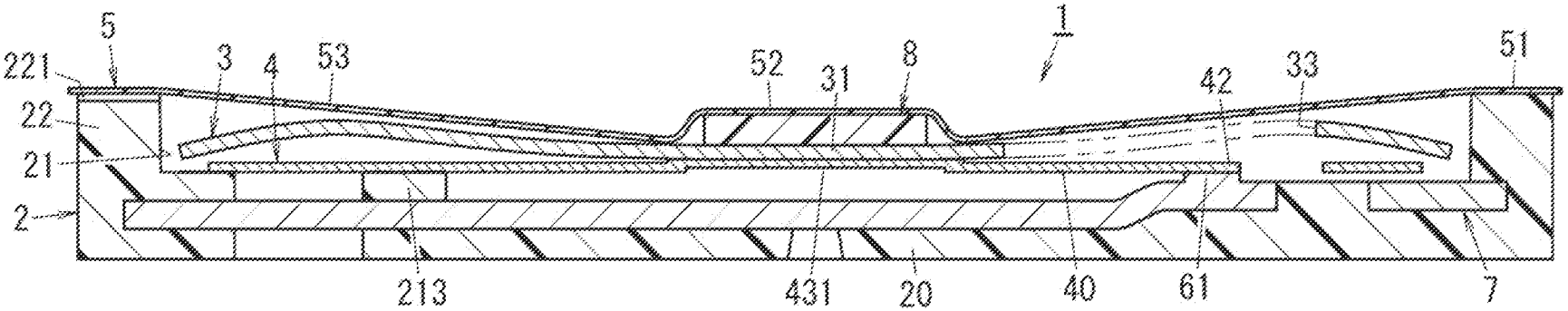
FIG. 6B is a cross-sectional view of a push switch according to an exemplary embodiment of the present invention that is being operated, taken along line X1-X1 in FIG. 3.

As illustrated in FIG. 6B, when push switch 1 is operated, downward operation force is applied to first pressure-receiving portion 431. In this case, touching piece 40 sags downward (in the direction from protective sheet 5 toward the bottom surface of recess 21), and movable contact 42 touches first fixed contact 611. Thus, movable contact member 4 and fixed contact member 6 are electrically connected. Specifically, push switch 1 is placed in an ON state where the pair of first terminal portions 612 and the pair of second terminal portions 73 illustrated in FIG. 1 are electrically connected via first fixed contact 611, movable contact 42, and the pair of second fixed contacts 72.

Figure 7:
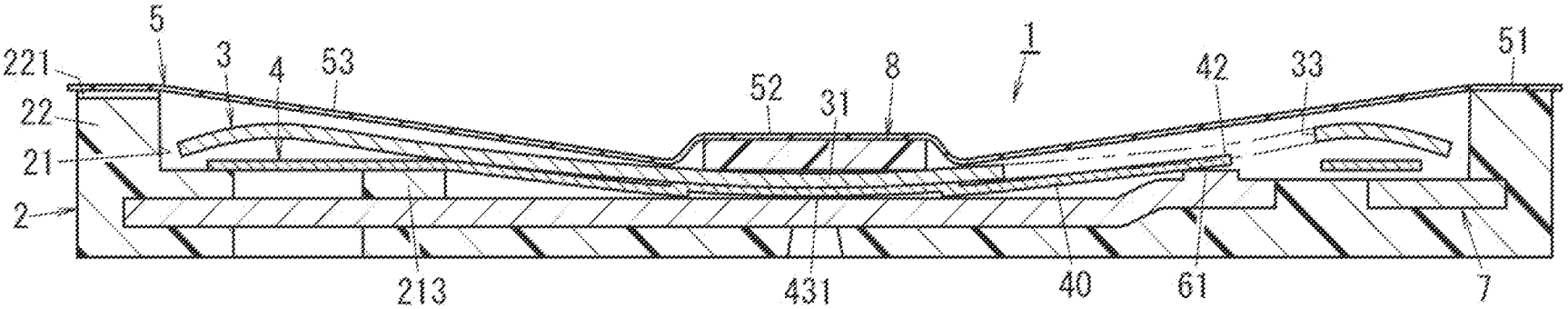
FIG. 7 is a cross-sectional view of a push switch according to an exemplary embodiment of the present invention in which overstroke has occurred, taken along line X1-X1 in FIG. 3.

Push switch 1 according to the present exemplary embodiment is what is called an overstroke switch. Specifically, in the state where movable contact 42 is in contact with first fixed contact 611 as illustrated in FIG. 6B, when first pressure-receiving portion 431 is pressed further down, further downward displacement (so-called overstroke) of first pressure-receiving portion 431 is allowed, as illustrated in FIG. 7.

Specifically, in push switch 1 according to the present exemplary embodiment, when first pressure-receiving portion 431 is pressed down and movable contact 42 touches first fixed contact 611, touching piece 40 of movable contact member 4 becomes parallel to a direction orthogonal to the upward and downward directions, as illustrated in FIG. 6B. In this state, when first pressure-receiving portion 431 is pressed down as illustrated in FIG. 7, a portion of touching piece 40 that is located between the proximal end supported by pedestal 213 and movable contact 42 supported by first fixed contact 611 sags downward, and the further downward displacement of first pressure-receiving portion 431 occurs. Therefore, when push switch 1 is operated, the timing of a sharp increase in operation load can be delayed from a point in time at which push switch 1 is placed in the ON state by the length of time for movement of first pressure-receiving portion 431 to the end point of the range of possible movement thereof.

Movable member 3 illustrated in FIG. 1 and FIG. 5A is disposed in recess 21 of case 21. Movable member 3 is located above movable contact member 4. For example, movable member 3 is formed from a metal plate and has elasticity. Movable member 3 is in the shape of a rectangle (specifically, a square) as viewed from above, and is formed in the shape of a dome (hemisphere) curved so that a central area thereof protrudes upward. The four corner parts of movable member 3 are respectively arranged on the upper surface of the four corner parts of movable contact member 4. The outer rim of movable member 3 is disposed along the inner peripheral surface of peripheral wall 22 of case 2. With this, movement of movable member 3 in a direction (horizontal direction) intersecting the upward and downward directions is restricted.

Movable member 3 includes pressure-receiving portion 31 which receives operation force upon operation of push switch 1. Hereinafter, pressure-receiving portion 31 will be referred to as second pressure-receiving portion 31. Second pressure-receiving portion 31 is a circular part overlapping first pressure-receiving portion 431 as viewed from above, and is located in a central area of movable member 3.

Movable member 3 according to the present exemplary embodiment includes a plurality of holes 33 (here, three holes 33). As viewed from above, the plurality of holes 33 are arranged at regular intervals on the same circle centered on the center of movable member 3. Each of the plurality of holes 33 penetrates movable member 3 along the upward and downward directions.

In the state illustrated in FIG. 6A where push switch 1 is not being operated, movable member 3 is disposed in recess 21 with only the four corner parts of movable member 3 in contact with movable contact member 4. At this time, second pressure-receiving portion 31 is not in contact with first pressure-receiving portion 431.

When push switch 1 is operated and second pressure-receiving portion 31 receives downward operation force, movable member 3 deforms so that second pressure-receiving portion 31 moves downward, as illustrated in FIG. 6B. Thus, first pressure-receiving portion 431 of movable contact member 4 is pressed down by second pressure-receiving portion 31, and movable contact 42 touches first fixed contact 611. In other words, first pressure-receiving portion 431 according to the present exemplary embodiment receives operation force from a user via second pressure-receiving portion 31.

As described above, when second pressure-receiving portion 31 is pressed down upon operation of push switch 1, movable member 3 gradually deforms so that a center area thereof including second pressure-receiving portion 31 protrudes downward. Subsequently, when the magnitude of the operation force acting on second pressure-receiving portion 31 exceeds a predetermined value, movable member 3 swiftly deforms into a dome shape curved so that second pressure-receiving portion 31 is convex downward. At this time, the force of elasticity of movable member 3 acting on second pressure-receiving portion 31 rapidly changes. Accordingly, a user operating push switch 1 is given a snap feeling (click feeling) along with the deformation of movable member 3.

As illustrated in FIG. 7, in the state of overstroke, the tip of touching piece 40 that has been warped is inserted into one of the plurality of holes 33 of movable member 33. Thus, in the state of overstroke, the tip of touching piece 40 and movable member 33 are kept from touching each other.

When the operation force acting on second pressure-receiving portion 31 is removed in the state where movable member 3 is in the downwardly convex dome shape as a result of deformation as illustrated in FIG. 6B and FIG. 7, movable member 3 is restored, by the force of its own elasticity, to a dome shape in which the central area of movable member 3 is convex upward as illustrated in FIG. 6A. Thus, movable contact 42 separates from first fixed contact 611, and push switch 1 turns OFF. Furthermore, when movable member 3 is restored in this manner, the force of elasticity of movable member 3 acting on second pressure-receiving portion 31 rapidly changes. Accordingly, a user who has released the operation of push switch 1 is given a snap feeling along with the deformation of movable member 3.

Protective sheet 5 illustrated in FIG. 1 and FIG. 2 is fixed to peripheral wall 22 of case 2. Protective sheet 5 according to the present exemplary embodiment is a flexible sheet made of synthetic resin. Specifically, protective sheet 5 is a resin film having heat resistance and electrical insulating properties. Protective sheet 5 is fixed to the upper surface of peripheral wall 22 of case 22 so as to cover recess 21. Protective sheet 5 covers the opening of recess 21, and mobile member 3, movable contact member 4, a part of fixed contact member 6, and a part of terminal 7 which are disposed in recess 21. Protective sheet 5 prevents dust and the like from entering recess 21. Thus, protective sheet 5 protects movable contact 42, first fixed contact 611, second fixed contact 72, and the like which are disposed in recess 21.

Figure 3:
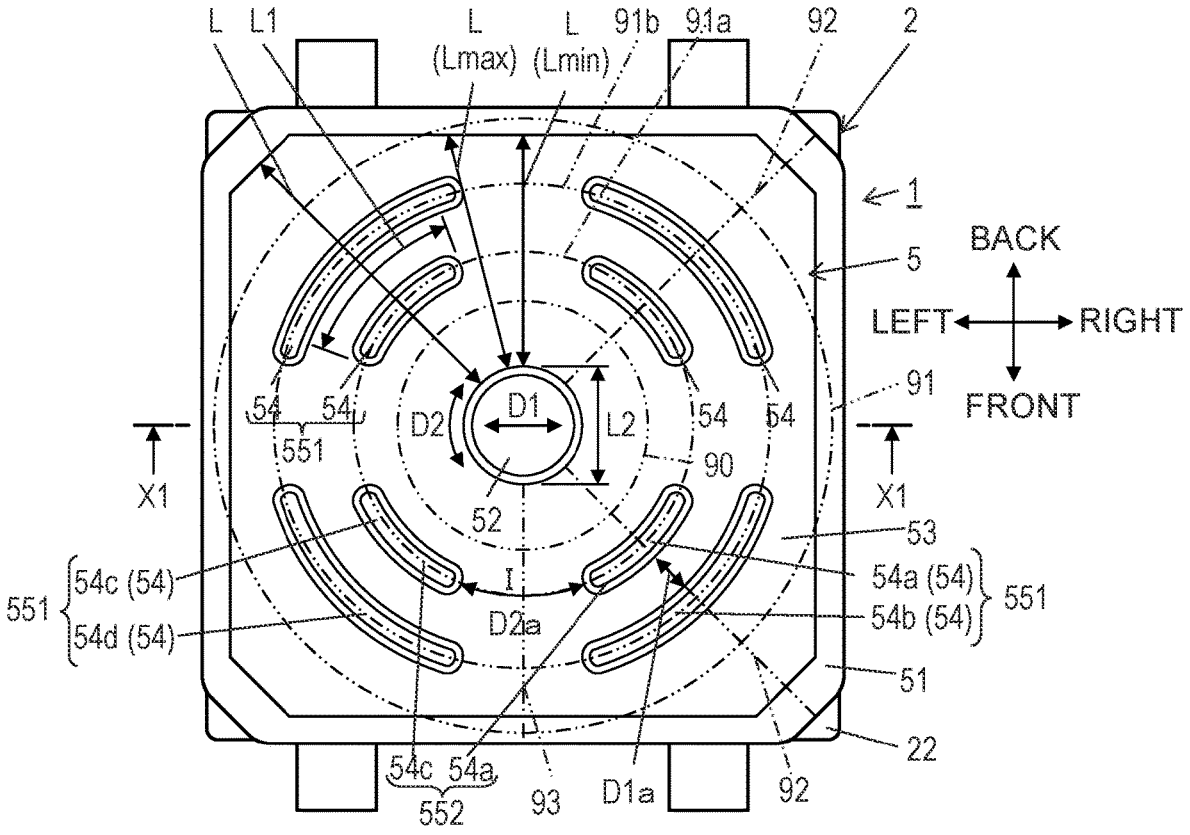
FIG. 3 is a plan view of a push switch according to an exemplary embodiment of the present invention.

As illustrated in FIG. 3, as viewed from above, the shape of protective sheet 5 according to the present exemplary embodiment is non-circular and symmetric with respect to the left and right directions and the forward and backward directions. The shape and size of the outline of protective sheet 5 is substantially the same as that of the outline of peripheral wall 22 of case 2. In other words, protective sheet 5 is formed in the shape of a rectangle (specifically, a square) as viewed from above.

Protective sheet 5 includes fixed portion 51, pressing portion 52, and intermediate portion 53. In protective sheet 5, fixed portion 51 is a portion fixed to case 2. Fixed portion 51 according to the present exemplary embodiment is a portion in the shape of a rectangular frame (specifically, a square frame) that constitutes an outer peripheral portion of protective sheet 5. In the present exemplary embodiment, fixed portion 51 is laser-welded to the upper surface of peripheral wall 22 of case 2, and thus protective sheet 5 is fixed to case 2.

Pressing portion 52 is a portion that is pressed by a user operating push switch 1 and that transmits the operation force to first pressure-receiving portion 431 via second pressure-receiving portion 31 upon operation of push switch 1. In other words, pressing portion 52 is a portion that presses movable contact member 4. Pressing portion 52 according to the present exemplary embodiment is located in a central area of protective sheet 5 and is circular as viewed from above. As viewed from above, the center of pressing portion 52 is located at the center of protective sheet 5.

As illustrated in FIG. 6A, pressing portion 52 according to the present exemplary embodiment protrudes more upward than the area in protective sheet 5 that surrounds pressing portion 52. Upon operation of push switch 1, pressing portion 52 is indirectly pressed by a user via pressing element 90 (refer to FIG. 3) disposed on pressing portion 52, for example.

As illustrated in FIG. 1 to FIG. 3, intermediate portion 53 is located between fixed portion 51 and pressing portion 52 and connects pressing portion 52 and fixed portion 51 disposed around pressing portion 52. Intermediate portion 53 according to the present exemplary embodiment is a portion of protective sheet 5 excluding fixed portion 51 and pressing portion 52. In other words, the entire area surrounded by frame-shaped fixed portion 51 of protective sheet 5 except for pressing portion 52 is intermediate portion 53.

In the present exemplary embodiment, pressing body 8 illustrated in FIG. 1 and FIG. 6A is disposed between pressing portion 52 of protective sheet 5 and second pressure-receiving portion 31 of movable member 3. Pressing body 8 is made from synthetic resin and has electrical insulating properties. Pressing body 8 according to the present exemplary embodiment is formed in the shape of a disc and the shape and size thereof as viewed from above is the same as that of pressing portion 52 of protective sheet 5. In other words, pressing portion 52 includes only a portion of protective sheet 5 that overlaps pressing body 8 as viewed from above. The upper surface of pressing body 8 is fixed to the lower surface of pressing portion 52 by laser welding, for example.

Pressing body 8 transmits the operation force applied to pressing portion 52 of protective sheet 5 to second pressure-receiving portion 31 of movable member 3. In other words, in the present exemplary embodiment, the operation force applied to pressing portion 52 of protective sheet 5 is indirectly transmitted to movable contact member 4 via pressing body 8 and movable member 3.

Upon operation of push switch 1, when pressing portion 52 is pressed down, second pressure-receiving portion 31 is pressed down by pressing body 8 fixed to pressing portion 52. Thus, in movable contact member 4, as mentioned above, first pressure-receiving portion 431 is pressed down by second pressure-receiving portion 31, and movable contact 42 touches first fixed contact 611. In other words, by receiving force from protective sheet 5 with pressing portion 52 pressed down, movable contact member 4 deforms so as to change the state of movable contact 42 between touching and not touching first fixed contact 611.

As illustrated in FIG. 1, peripheral wall 22 of case 2 according to the present exemplary embodiment includes groove 221. Groove 221 is formed in the upper surface of peripheral wall 22. One end of groove 221 extends to the outer rim of peripheral wall 22, and the other end of groove 221 extends to the inner rim of peripheral wall 22.

The upper surface of peripheral wall 22 excluding groove 221 constitutes fixing surface 220 to which fixed portion 51 of protective sheet 5 is fixed. Fixing surface 220 is a flat face (horizontal face) orthogonal to the upward and downward directions.

Fixed portion 51 of protective sheet 5 according to the present exemplary embodiment is fixed to fixing surface 220 (the upper surface of wall 222 and the upper surface of wall 223) by laser welding. Note that in a region where groove 221 is formed, fixed portion 51 cannot be fixed to the upper surface of case 2. In other words, fixed portion 51 of protective sheet 5 is fixed to the upper surface of case 2, in a region extending all around the perimeter except for a region where groove 221 is formed.

The space inside push switch 1 surrounded by recess 21 and protective sheet 5 is in communication with the space outside push switch 1 via groove 221. Therefore, as illustrated in FIG. 6B, upon operation of push switch 1, when pressing portion 52 of protective sheet 5 is pressed down, the air in the space inside push switch 1 is discharged to the space outside push switch 1 through groove 221. This reduces a deterioration in operation touch that is due to compression of the air in the space inside push switch 1. Furthermore, this makes it possible to operate push switch 1 with relatively low operation force. Moreover, upon recovery operation of push switch 1 after operation (upon restoration of movable member 3), the air outside push switch 1 flows into recess 21 through groove 221. This makes the recovery operation of push switch 1 satisfactory.

As illustrated in FIG. 1 to FIG. 3, protective sheet 5 according to the present exemplary embodiment includes at least one rib 54. Here, more than one rib 54 is provided. A plurality of ribs 54 are formed on intermediate portion 53 of protective sheet 5. As illustrated in FIG. 2, rib 54 protrudes more upward than an area around rib 54 in protective sheet 5.

As illustrated in FIG. 3, the outline of pressing portion 52 is circular as viewed from above, and in the present exemplary embodiment, the radial direction of pressing portion 52 is defined as radial direction D1, and a direction along the outline of the pressing portion is defined as circumferential direction D2. Note that radial direction D1 is the left and right directions in FIG. 3, but is not limited to the left and right directions and all the directions along the diameter of the circle defining the outline of the pressing portion is referred to as radial direction D1. In other words, the direction of any line passing through the center of pressing portion 52 is referred to as radial direction D1.

Assume virtual circle 91 which is concentric with pressing portion 52 as viewed from above; the radial direction of virtual circle 91 matches radial direction D1, and the circumferential direction of virtual circle 91 matches circumferential direction D2.

The plurality of ribs 54 according to the present exemplary embodiment include a plurality of ribs 54 arranged with spacing therebetween in radial direction D1. For example, rib 54*a* and rib 54*b* illustrated in FIG. 3 are arranged with spacing therebetween in radial direction Dia. Here, rib 54*a* and rib 54*b* are referred to as rib set 551.

Furthermore, the plurality of ribs 54 according to the present exemplary embodiment include a plurality of ribs 54 arranged with spacing therebetween in radial direction D2. For example, rib 54*a* and rib 54*c* illustrated in FIG. 3 are arranged with spacing therebetween in radial direction D2*a*. Rib 54*a* and rib 54*c* are provided on protective sheet 5 in such a manner as to be arranged with spacing therebetween on virtual circle 91*a* centered on pressing portion 52. Rib 54*b* and rib 54*d* are arranged with spacing therebetween in circumferential direction D2. Rib 54*b* and rib 54*d* are provided on protective sheet 5 in such a manner as to be arranged with spacing therebetween on virtual circle 91*b* centered on pressing portion 52.

In other words, protective sheet 5 according to the present exemplary embodiment includes: a plurality of ribs 54 (for example, rib 54*a* and rib 54*c*) arranged with spacing therebetween on virtual circle 91*a*; and a plurality of ribs 54 (for example, rib 54*b* and rib 54*d*) arranged with spacing therebetween on virtual circle 91*b*.

Here, the plurality of ribs 54 arranged with spacing therebetween in radial direction D1 are referred to as rib set 551. For example, ribs 54*a* and rib 54*b* arranged with spacing therebetween in radial direction D1*a* illustrated in FIG. 3 constitute one rib set 551. Thus, in the present exemplary embodiment, four rib sets 551 are provided on protective sheet 5 in such a manner as to be arranged with spacing therebetween in circumferential direction D2.

Each rib set 551 is made up of the same number of ribs 54. Here, each rib set 551 is made up of two ribs 54 arranged in radial direction D1.

Rib 54 is disposed across diagonal 92 of quadrate protective sheet 5 as viewed from above. In the present exemplary embodiment, in protective sheet 5, rib 54 is not formed in an area overlapping virtual straight line 93 extending from pressing portion 52 perpendicularly with respect to a side of quadrate protective sheet 5 and passing through pressing portion 52 as viewed from above. Note that protective sheet 5 appears square in FIG. 3, but may, in actuality, be rectangular.

Furthermore, the plurality of ribs 54 according to the present exemplary embodiment are located on the inner side of the inner peripheral surface of recess 21 (refer to FIG. 1) as viewed from above. This reduces inhibition of deformation of protective sheet 5 due to portions of protective sheet 5 where the plurality of ribs 54 are formed touching the inner peripheral surface of recess 21 upon operation of push switch 1. Thus, good operation touch of push switch 1 is achieved.

The plurality of ribs 54 according to the present exemplary embodiment are disposed on the outer side of pressing element 90 (refer to FIG. 3) as viewed from above. Therefore, the plurality of ribs 54 are less likely to be pressed by pressing element 90, and the operation touch is less likely to be inhibited.

In the present exemplary embodiment, spacing I (refer to FIG. 3) between rib 54*a* and rib 54*c*, which are adjacent to each other, along circumferential direction D2*a* is greater than maximum length L2 of pressing portion 52 as viewed from above. In the present exemplary embodiment, maximum length L2 of pressing portion 52 is the diameter of circular pressing portion 52.

Each rib 54 in the present exemplary embodiment is integrally formed with intermediate portion 53. Each rib 54 is formed on the upper surface of intermediate portion 53 and protrudes upward. Intermediate portion 53 is thicker in an area where rib 54 is formed than in the other areas. The thickness of protective sheet 5 according to the present exemplary embodiment in an area where rib 54 is not formed is constant.

In the present exemplary embodiment, the plurality of ribs 54 arranged at the same position in radial direction D1 have the same shape and size. In other words, the plurality of ribs 54 arranged on the same virtual circle have the same shape and size. As illustrated in FIG. 3, for example, rib 54*a* and rib 54*c* arranged on virtual circle 91*a* have the same shape and size. Rib 54*b* and rib 54*d* arranged on virtual circle 91*b* have the same shape and size.

The shape of each rib 54 is symmetric with respect to a line that is diagonal 92 passing through said rib 54. Specifically, rib 54 is formed in the shape of a circular arc centered on the center of pressing portion 52 (the center of protective sheet 5) as viewed from above. In other words, each rib 54 extends in circumferential direction D2 as viewed from above. Stated differently, each rib 54 extends in a direction intersecting with radial direction D1.

Among the plurality of ribs 54 constituting rib set 551 (specifically, the plurality of ribs 54 arranged in radial direction D1), rib 54 located farther away from pressing portion 52 (located closer to the outer rim of protective sheet 5) has a greater length (which is the size in circumferential direction D2), as viewed from above. The plurality of ribs 54 are disposed, however, in such a manner that every spacing between ribs 54 that are adjacent to each other in circumferential direction D2 becomes the same. In other words, ribs 54 on the same virtual circle (such as virtual circle 91*a*) are disposed in such a manner that every spacing between ribs 54 that are adjacent to each other in circumferential direction D2 becomes the same. As an example, four ribs 54 (such as rib 54*a* and rib 54*c*) on the same virtual circle 91*a* are disposed in such a manner that every spacing I between ribs 54 that are adjacent to each other in circumferential direction D2 becomes the same.

In push switch 1 according to the present exemplary embodiment, it is possible to adjust the natural frequency of protective sheet 5 by changing the position, number, size, shape, etc., of ribs 54 on protective sheet 5. Therefore, upon operation of push switch 1, the production of sound having an unintended frequency from protective sheet 5 can be reduced. For example, as in the present exemplary embodiment, rib 54 is formed in an area of intermediate portion 53 of protective sheet 5 which overlaps diagonal 92 and in which distance L between pressing portion 52 and fixed portion 51 is longest, and thus the natural frequency of protective sheet 5 can be reduced. In this case, particularly, the production of sound with a frequency of approximately 10 kHz that is likely to be offensive to the ears of a user can be reduced.

As a result of forming rib 54 on protective sheet 5, the rigidity of protective sheet 5 increases, and it is possible to reduce sound by reducing the sound pressure of protective sheet 5 upon operation of push switch 1. Particularly, as in the present exemplary embodiment, in the case where protective sheet 5 has a quadrate shape, pressing portion 52 is located in the central area of protective sheet 5, and fixed portion 51 is located at the rim of protective sheet 5, forming rib 54 on protective sheet 5 is especially effective in reducing sound. In other words, in protective sheet 5 according to the present exemplary embodiment, distance L between pressing portion 52 and fixed portion 51 varies along circumferential direction D2. Therefore, upon operation of push switch 1, when pressing portion 52 is pressed down, stress (tension) applied to each part of protective sheet 5 is different along circumferential direction D2. In the present exemplary embodiment, distance L in an area of protective sheet 5 that overlaps diagonal 92 is longest, and distance L in an area of protective sheet 5 that overlaps virtual straight line 93 is shortest. Therefore, particularly, in protective sheet 5, there is likely to be a large difference in stress between the area overlapping diagonal 92 and the area overlapping virtual straight line 93, and thus protective sheet 5 may buckle due to the difference in stress, leading to production of sound. Here, in protective sheet 5 according to the present exemplary embodiment, rib 54 is formed in the area overlapping diagonal 92. With this, the vibration in the area of protective sheet 5 that overlaps diagonal 92 is suppressed, and thus it is possible to reduce the occurrence of buckling. Specifically, in the present exemplary embodiment, it is possible to reduce the difference between maximum value Lmax of distance L and minimum value Lmin of distance L in an area of protective sheet 5 where vibration is likely to occur (where rib 54 is not formed), and thus the occurrence of buckling can be reduced. Therefore, it is possible to effectively reduce the production of sound in protective sheet 5.

(3) Variations

Next, variations of the exemplary embodiment described above will be described.

(3-1) Variation 1

Figure 8:
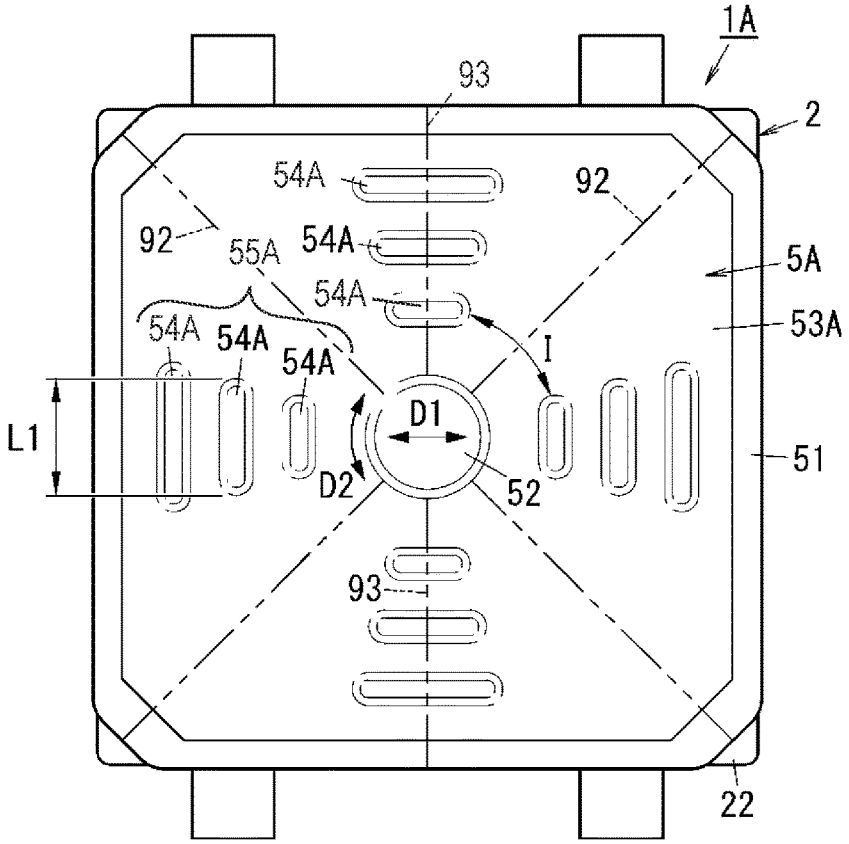
FIG. 8 is a plan view of a push switch according to Variation 1.

Push switch 1A according to Variation 1 illustrated in FIG. 8 includes a plurality of ribs 54A instead of the plurality of ribs 54 according to the exemplary embodiment described above. Push switch 1A has substantially the same configuration as push switch according to the exemplary embodiment described above. Therefore, push switch 1A will be described below focusing on only the points of difference from push switch 1 while omitting points that overlap with push switch 1.

Push switch 1A includes protective sheet 5A instead of protective sheet 5 according to the exemplary embodiment described above. Protective sheet 5A has substantially the same configuration as protective sheet 5. However, protective sheet 5A includes intermediate portion 53A instead of intermediate portion according to the exemplary embodiment described above. Intermediate portion 53A has substantially the same configuration as intermediate portion 53 according to the exemplary embodiment described above, connecting pressing portion 52 and fixed portion 51. However, instead of the plurality of ribs 54, the plurality of ribs 54A are formed on intermediate portion 53A according to the present variation.

Protective sheet 5A according to the present variation includes a plurality of rib sets 55A, each of which is made up of a plurality of ribs 54A arranged with spacing therebetween in radial direction D1, with spacing therebetween in circumferential direction D2. Each rib set 55A includes the same number of ribs 54A. In the variation illustrated in FIG. 8, rib set 55A is made up three ribs 54A. In the present variation, four rib sets 55A each made up of three ribs 54A are provided on protective sheet 5A.

Each rib 54A is located on virtual straight line 93 as viewed from above. Rib 54A is not formed in an area of protective sheet 5A that overlaps diagonal 92.

Rib 54 is formed on the upper surface of intermediate portion 53A and protrudes upward. In the present variation, the plurality of ribs 54A arranged at the same position in radial direction D1 have the same shape and size. In other words, the plurality of ribs 54A disposed on the same virtual circle have the same shape and size.

The shape of rib 54A is symmetric with respect to a line that is virtual straight line 93 which extends from the center of pressing portion 52, passes through said rib 54A, and is orthogonal to a side of quadrate protective sheet 5A, as viewed from above. Specifically, each rib 54A is formed in a straight line orthogonal to radial direction D1 as viewed from above.

Among the plurality of ribs 54A constituting each rib set 55A (specifically, the plurality of ribs 54A arranged in radial direction D1), rib 54A located farther away from pressing portion 52 has greater length L1 (which is the size in a direction orthogonal to radial direction D1 as viewed from above), as viewed from above.

In the present variation, rib 54A is formed in an area of intermediate portion 53A of protective sheet 5A which overlaps virtual straight line 93 and in which distance L between pressing portion 52 and fixed portion 51 is short, and thus protective sheet 5A has an increased natural frequency, and it is possible to reduce the production of a low frequency sound.

(3-2) Variation 2

Figure 9:
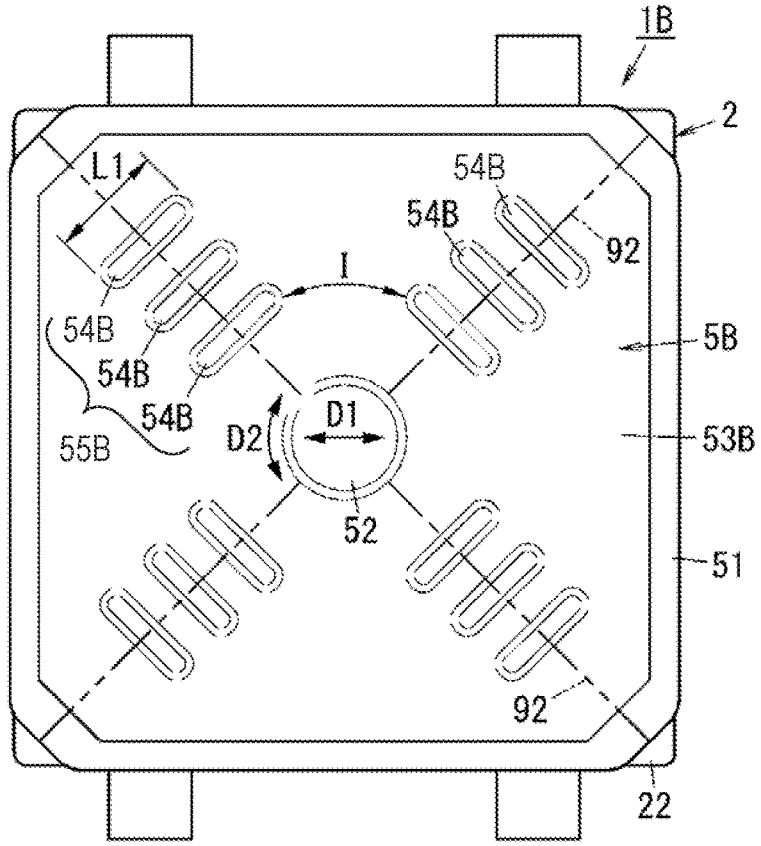
FIG. 9 is a plan view of a push switch according to Variation 2.

Push switch 1B according to Variation 2 illustrated in FIG. 9 includes a plurality of ribs 54B instead of the plurality of ribs 54 according to the exemplary embodiment described above. Push switch 1B has substantially the same configuration as push switch according to the exemplary embodiment described above. Therefore, push switch 1B will be described below focusing on only the points of difference from push switch 1 while omitting points that overlap with push switch 1.

Push switch 1B includes protective sheet 5B instead of protective sheet 5 according to the exemplary embodiment described above. Protective sheet 5B has substantially the same configuration as protective sheet 5. However, protective sheet 5B includes intermediate portion 53B instead of intermediate portion according to the exemplary embodiment described above. Intermediate portion 53B has substantially the same configuration as intermediate portion 53 according to the exemplary embodiment described above, connecting pressing portion 52 and fixed portion 51. However, instead of the plurality of ribs 54, the plurality of ribs 54B are formed on intermediate portion 53B.

Protective sheet 5B according to the present variation includes a plurality of rib sets 55B, each of which is made up of a plurality of ribs 54B arranged with spacing therebetween in radial direction D1, with spacing therebetween in circumferential direction D2. Each rib set 55B includes the same number of ribs 54B. In the variation illustrated in FIG. 9, rib set 55B is made up three ribs 54B. In the present variation, four rib sets 55B each made up of three ribs 54B are provided on protective sheet 5A.

Each rib 54B is located on diagonal 92 as viewed from above. Each rib 54B is formed on the upper surface of protective sheet 5B and protrudes upward. The plurality of ribs 54B according to the present variation have the same shape and size.

The shape of each rib 54B is symmetric with respect to a line that is diagonal 92 passing through said rib 54B as viewed from above. Specifically, each rib 54B is formed in a straight line extending in the direction orthogonal to radial direction D1 as viewed from above.

The plurality of ribs 54B constituting each rib set 55B (the plurality of ribs 54B arranged in radial direction D1) have the same length L1 (which is the size in the direction orthogonal to radial direction D1 as viewed from above). However, the plurality of ribs 54B are disposed in such a manner that spacing I between ribs 54B adjacent to each other along circumferential direction D2 increases with the distance from pressing portion 52.

(3-2) Comparison between Variations 1 and 2 and Comparative Example

Figure 10A:
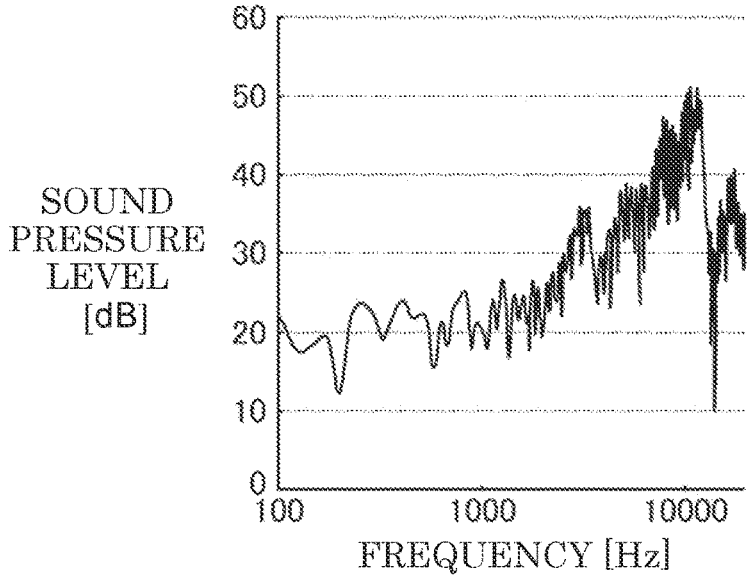
FIG. 10A is a graph showing the relationship between the frequency of a produced sound and a sound pressure level when a push switch according to a comparative example is operated.
Figure 10B:
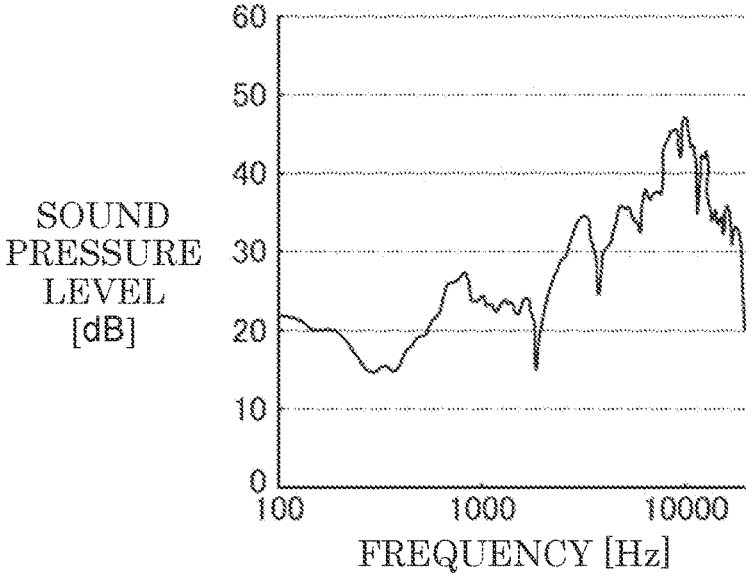
FIG. 10B is a graph showing the relationship between the frequency of a produced sound and a sound pressure level when a push switch according to Variation 1 is operated.
Figure 10C:
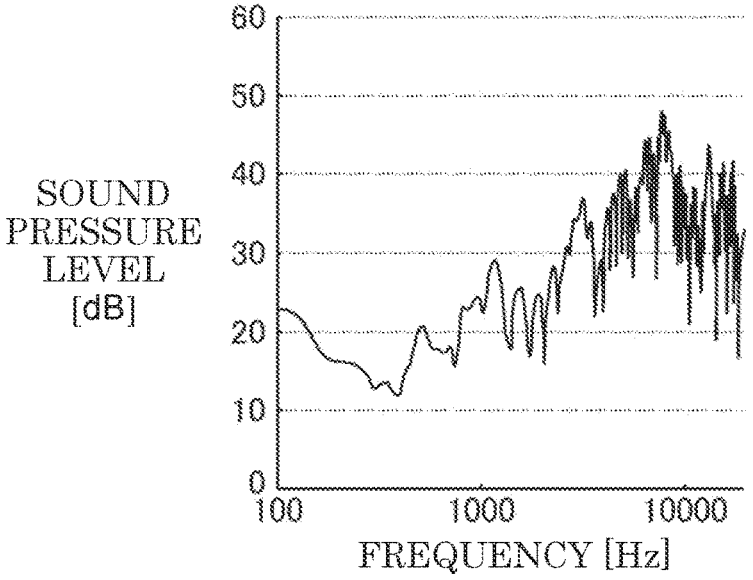
FIG. 10C is a graph showing the relationship between the frequency of a produced sound and a sound pressure level when a push switch according to Variation 2 is operated.

FIG. 10B is a graph showing the relationship between the frequency of a produced sound and a sound pressure level when push switch 1A according to Variation 1 is operated. FIG. 10C is a graph showing the relationship between the frequency of a produced sound and a sound pressure level when push switch 1B according to Variation 2 is operated. FIG. 10A is a graph showing the relationship between the frequency of a produced sound and a sound pressure level when a push switch according to a comparative example is operated. Note that the push switch according to the comparative example is different from push switch 1A according to Variation 1 only in that ribs 54A are not formed on protective sheet 5A.

As is clear from FIG. 10A and FIG. 10C, the peak frequency (a frequency at which the sound pressure level becomes highest) of push switch 1B according to Variation 2 is lower than that of the push switch according to the comparative example. Furthermore, as is clear from FIG. 10A to FIG. 10C, the highest sound pressure level of each of push switches 1A and 1B according to Variations 1 and 2 is lower than that of the push switch according to the comparative example; thus, sound reduction is attained.

(3-3) Variation 3

Figure 11:
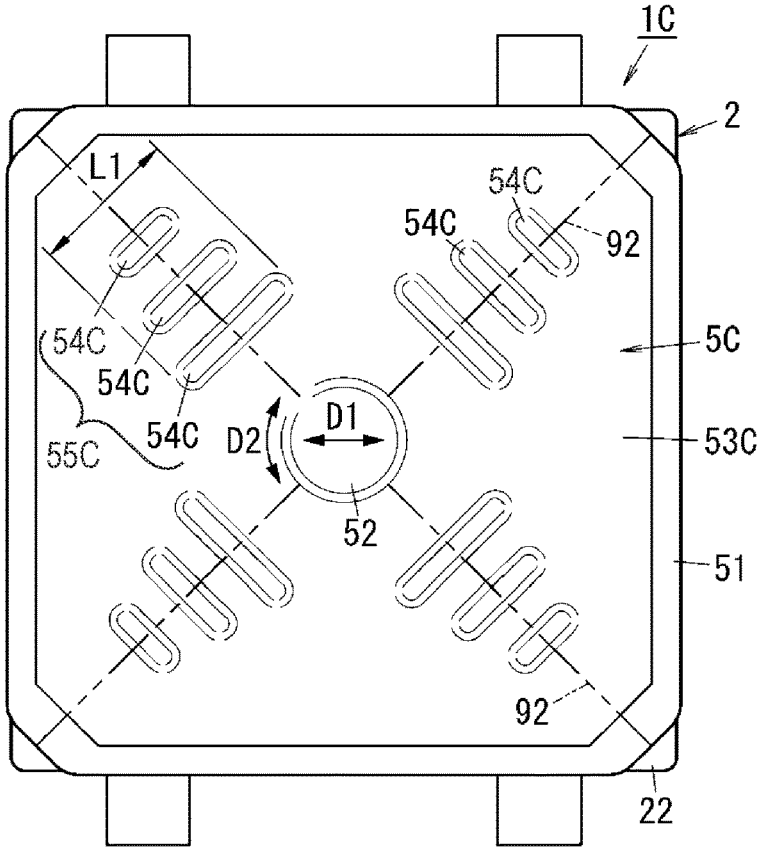
FIG. 11 is a plan view of a push switch according to Variation 3.

Push switch 1C according to Variation 3 illustrated in FIG. 11 includes a plurality of ribs 54C instead of the plurality of ribs 54 according to the exemplary embodiment described above. Push switch 1C has substantially the same configuration as push switch according to the exemplary embodiment described above. Therefore, push switch 1C will be described below focusing on only the points of difference from push switch 1 while omitting points that overlap with push switch 1.

Push switch 1C includes protective sheet 5C instead of protective sheet 5 according to the exemplary embodiment described above. Protective sheet 5C has substantially the same configuration as protective sheet 5. However, protective sheet 5C includes intermediate portion 53C instead of intermediate portion according to the exemplary embodiment described above. Intermediate portion 53C has substantially the same configuration as intermediate portion 53 according to the exemplary embodiment described above, connecting pressing portion 52 and fixed portion 51. However, instead of the plurality of ribs 54, the plurality of ribs 54C are formed on intermediate portion 53C.

Protective sheet 5C according to the present variation includes a plurality of rib sets 55C, each of which is made up of a plurality of ribs 54C arranged with spacing therebetween in radial direction D1, with spacing therebetween in circumferential direction D2. Each rib set 55C includes the same number of ribs 54C. In the variation illustrated in FIG. 11, rib set 55C is made up of three ribs 54C. In the present variation, four rib sets 55C each made up of three ribs 54C are provided on protective sheet 5A.

Each rib 54C is located on diagonal 92 as viewed from above. Each rib 54C is formed on the upper surface of protective sheet 5A and protrudes upward. In the present variation, the plurality of ribs 54C arranged at the same position in radial direction D1 have the same shape and size.

The shape of each rib 54C is symmetric with respect to a line that is diagonal 92 passing through said rib 54C, as viewed from above. Specifically, each rib 54C is formed in a straight line extending in the direction orthogonal to radial direction D1 as viewed from above.

Among the plurality of ribs 54C constituting each rib set 55C (the plurality of ribs 54C arranged in radial direction D1), rib 54C located farther away from pressing portion 52 has less length L1 (which is the size in a direction orthogonal to diagonal 92), as viewed from above.

(3-4) Variation 4

Figure 12:
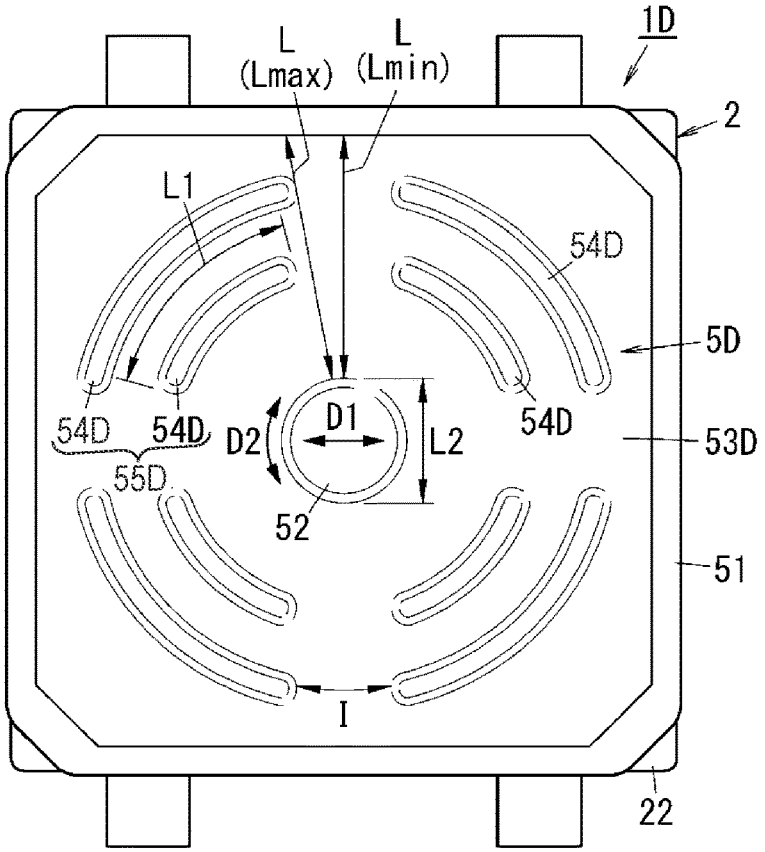
FIG. 12 is a plan view of a push switch according to Variation 4.

Push switch 1D according to Variation 4 illustrated in FIG. 12 includes a plurality of ribs 54D instead of the plurality of ribs 54 according to the exemplary embodiment described above. Push switch 1D has substantially the same configuration as push switch according to the exemplary embodiment described above. Therefore, push switch 1D will be described below focusing on only the points of difference from push switch 1 while omitting points that overlap with push switch 1.

Push switch 1D includes protective sheet 5D instead of protective sheet 5 according to the exemplary embodiment described above. Protective sheet 5D has substantially the same configuration as protective sheet 5. However, protective sheet 5D includes intermediate portion 53D instead of intermediate portion according to the exemplary embodiment described above. Intermediate portion 53D has substantially the same configuration as intermediate portion 53 according to the exemplary embodiment described above, connecting pressing portion 52 and fixed portion 51. However, instead of the plurality of ribs 54, the plurality of ribs 54D are formed on intermediate portion 53D according to the present variation.

The plurality of ribs 54D have substantially the same configuration as the plurality of ribs 54 according to the exemplary embodiment described above. However, each of the plurality of ribs 54D has greater length L1 (which is the size along circumferential direction D2) than rib 54 according to the exemplary embodiment described above (refer to FIG. 3).

In the present variation, spacing I along circumferential D2, between ribs 54D that are adjacent to each other in the circumferential direction, is less than the greatest length L2 of pressing portion 52 (which is the diameter of pressing portion 52) as viewed from above. Therefore, it is possible to reduce the difference between maximum value Lmax of distance L and minimum value Lmin of distance L in an area of protective sheet 5 where vibration is likely to occur (where rib 54D is not formed), and thus the production of sound in protective sheet 5 can further be reduced.

(3-5) Variation 5

Figure 13:
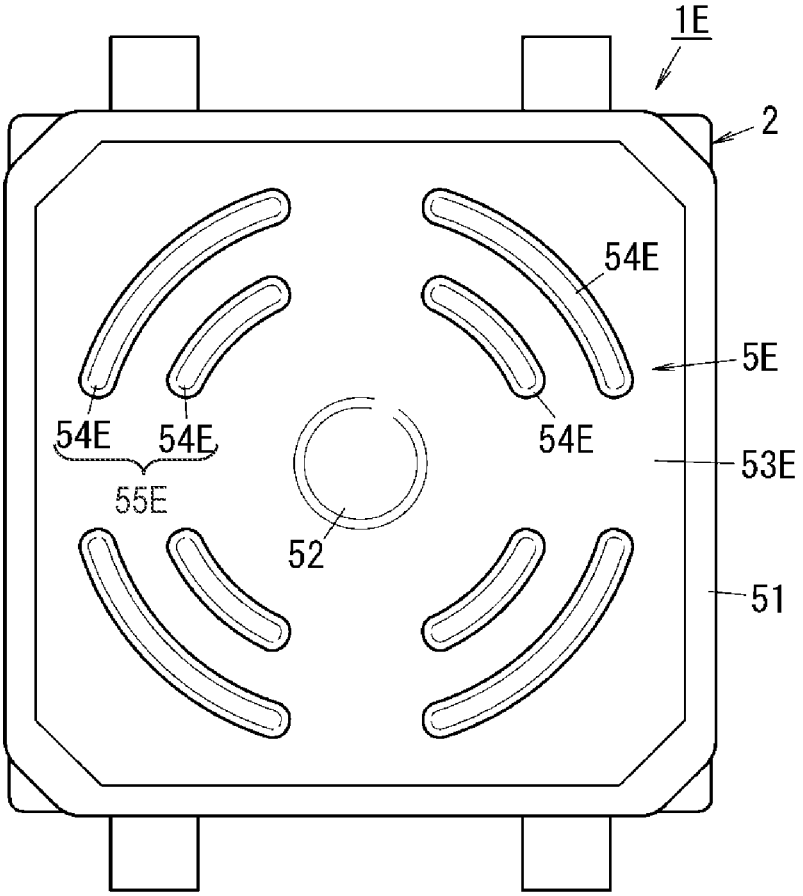
FIG. 13 is a plan view of a push switch according to Variation 5.

Push switch 1E according to Variation 4 illustrated in FIG. 13 includes a plurality of ribs 54E instead of the plurality of ribs 54 according to the exemplary embodiment described above. Push switch 1E has substantially the same configuration as push switch according to the exemplary embodiment described above. Therefore, push switch 1E will be described below focusing on only the points of difference from push switch 1 while omitting points that overlap with push switch 1.

Push switch 1E according to the present variation includes protective sheet 5E instead of protective sheet 5 according to the exemplary embodiment described above. Protective sheet 5E has substantially the same configuration as protective sheet 5. However, protective sheet 5E includes intermediate portion 53E instead of intermediate portion 53 according to the exemplary embodiment described above. Intermediate portion 53E has substantially the same configuration as intermediate portion 53 according to the exemplary embodiment described above, connecting pressing portion 52 and fixed portion 51. However, the plurality of ribs 54 are not formed on intermediate portion 53E.

The plurality of ribs 54E are members separate from protective sheet 5E and are not integrally formed with protective sheet 5E. Each of the plurality of ribs 54E is attached to intermediate portion 53E of protective sheet 5E. Each of the plurality of ribs 54E is attached to the upper surface of intermediate portion 53E and protrudes upward from intermediate portion 53E. In the variation illustrated in FIG. 13, rib set 55E is made up of two ribs 54E. In the present variation, four rib sets 54E each made up of two ribs 54E are provided on protective sheet 5E.

Note that in the present exemplary embodiment, the plurality of ribs 54E are members separate from protective sheet 5E; in the exemplary embodiment described above, the plurality of ribs 54 (54A to 54D) are members separate from protective sheet 5 (5A to 5D).

Rib 54E is, for example, a member attached to intermediate portion 53E via a bonding or adhesive agent and is formed from a material different from the material of protective sheet 5E (intermediate portion 53E). The plurality of ribs 54E according to the present variation have substantially the same configuration as the plurality of ribs 54 according to the exemplary embodiment described above except that the plurality of ribs 54E are members separate from protective sheet 5E.

Stated differently, in each of the exemplary embodiments, the plurality of ribs 55 (55A to 55E) are provided on protective sheet 5 (5A to 5E).

In push switch 1E according to the present variation, it is possible to easily change the position of each rib 54E by merely changing a position at which said rib 54E is attached to protective sheet 5E. Furthermore, it is possible to easily change the rigidity (spring constant), the internal loss, etc., of each rib 54E by changing the material of said rib 54E. Therefore, it is possible to easily adjust the natural frequency of protective sheet 5.

(4) Other Variations

Note that the design of push switches 1 to 1E according to the exemplary embodiment and variations described above can be changed, as appropriate.

For example, the shape and size of each of ribs 54 to 54E is not limited. For example, the radii of curvature of ribs 54 each in the shape of a circular arc according to the exemplary embodiment described above may be different from each other. Furthermore, rib 54 according to the exemplary embodiment described above and rib 54E according to Variation 5 may each be in a straight line intersecting with radial direction D1 as viewed from above. The shape of each of ribs 54A to 54C according to Variations 1 to 3 as viewed from above may be in a straight line intersecting with radial direction D1 at an angle other than 90 degrees. Alternatively, the shape of each of ribs 54A to 54C according to Variations 1 to 3 as viewed from above may be a circular arc centered on the center of pressing portion 52. Furthermore, the widths of the plurality of ribs 54 to 54E (which are the sizes in radial direction D1) may be different from each other.

Furthermore, each of ribs 54 to 54D according to the exemplary embodiment described above and Variations 1 to 4 may be formed on the lower surface of a corresponding one of protective sheets 5 to 5D. Each rib 54E according to Variation 5 may be attached to the lower surface of intermediate portion 53E. Stated differently, ribs 54 to 54E may be provided on the lower surfaces of protective sheets 5 to 5E.

Furthermore, each rib 54E according to Variation 5 may be formed from the same material as protective sheet 5E as long as said rib 54E is a member separate from protective sheet 5E. Each rib 54E according to Variation 5 may be a bonding or adhesive agent attached to intermediate portion 53E.

Furthermore, in Variation 4, circumferential spacing I between ribs 54D that are adjacent to each other in the circumferential direction may be equal to maximum length L2 of pressing portion 52. Specifically, it is sufficient that spacing I be less than or equal to maximum length L2 of pressing portion 52.

Furthermore, the number of ribs 54 to 54E included in protective sheets 5 to 5E is not limited; for example, ribs 54 to 54E may each be formed only one on a corresponding one of protective sheets 5 to 5E.

Furthermore, fixed portion 51 of each of protective sheets 5 to 5E may be fixed to the upper surface of peripheral wall 22 of case 22 by welding other than laser welding such as welding with use of a heater, ultrasonic welding, and vibration welding or may be fixed to the upper surface of peripheral wall 22 of case 22 via a bonding or adhesive agent.

Furthermore, pressing portion 52 of protective sheets 5 to 5E may be directly operated by pressure from a user without the use of other members such as pressing element 90. Moreover, the shape of pressing portion 52 is not limited to a circle as viewed from above and may be an ellipse, a polygon, or the like.

Furthermore, it is sufficient that each of protective sheets 5 to 5E cover at least a part of recess 21; covering the entirety of recess 21 is not an essential feature of each of push switches 1 to 1E. For example, a hole may be formed in a part of protective sheets 5 to 5E.

Furthermore, groove 221 is not required in the upper surface of peripheral wall 22 of case 2. In this case, for example, the whole upper surface of peripheral wall 22 is flat, and the outer rim of each of protective sheets 5 to 5E is fixed to the upper surface of peripheral wall 22 throughout the entire circumferential length of said one of protective sheets 5 to 5E.

Furthermore, pressing body 8 may be disposed above pressing portion 52 of each of protective sheets 5 to 5E, for example. In this case, the lower surface of pressing body 8 is fixed to the upper surface of each of protective sheets 5 to 5E, and the operation force acting on pressing body 8 is transmitted to second pressure-receiving portion 31 via pressing portion 52.

Furthermore, push switches 1 to 1E are not required to include movable member 3. In this case, the operation force applied to pressing portion 52 of each of protective sheets 5 to 5E is transmitted to first pressure-receiving portion 431 of movable contact member 4 via pressing body 8, for example. Furthermore, push switches 1 to 1E are not required to include pressing body 8. In this case, the operation force applied to pressing portion 52 of each of protective sheets 5 to 5E is directly transmitted to second pressure-receiving portion 31 of movable member 3.

Furthermore, the shape of the opening of recess 21 of case 2 is not limited to the approximate square shape and may be, for example, rectangular, circular, or oval.

Furthermore, push switches 1 to 1E may each be of a two-stage operation type including a first contact and a second contact. In push switches 1 to 1E of the two-stage operation type, when pressing portion 52 is pressed, first, the first contact turns ON, and when pressing portion 52 in the state where the first contact is ON is further pressed, then the second contact turns ON. Push switch 1 is not limited to the normally-open switch and may be a normally-closed switch which turns OFF only upon operation. Furthermore, push switches 1 to 1E may each be a switch different from the overstroke switch.

Furthermore, push switches 1 to 1E are not limited to being used in an operation unit of a device and operated by a person, and may be used, for example, in a sensing unit, etc., of a device. In the case where push switches 1 to 1E are used in a sensing unit of a device, push switches 1 to 1E are used as a limit switch, for example, for detecting the position of a mechanical part such as an actuator.

Note that most of protective sheet 5 described in the present disclosure is square, but protective sheet 5 does not necessarily need to be square; as illustrated in FIG. 1, rectangular protective sheet 5 may be used.

(5) Summary

As is clear from the description above, push switch 1 (1A to 1E) according to the present disclosure includes: case 2 configured to include recess 21; fixed contact member 6 configured to include first fixed contact 611 disposed in recess 21; movable contact member 4 configured to include movable contact 42 disposed in recess 21; protective sheet 5 (5A to 5E) disposed in a first direction (upward) from recess 21 and configured to cover recess 21; and rib 54 (54A to 54E) disposed on protective sheet 5 (5A to 5E).

Protective sheet 5 (5A to 5E) includes: pressing portion 52; fixed portion 51 fixed to case 2; and intermediate portion 53 (53A to 53E) located between pressing portion 52 and fixed portion 51 as viewed in the first direction (from above).

As pressing portion 52 of protective sheet 5 (5A to 5E) is pressed along the first direction (from above), movable contact member 4 deforms by force received from protective sheet 5 (5A to 5E), and movable contact 42 touches first fixed contact 611 as a result of the deformation of movable contact member 4.

With this configuration, it is possible to reduce the spring constant by partially increasing the rigidity of intermediate portion 53 (53A to 53E) of protective sheet 5 (5A to 5E) in an area where rib 54 (54A to 54E) is formed. Furthermore, by changing the position, number, size, shape, etc., of ribs 54 (54A to 54E), the natural frequency of protective sheet 5 (5A to 5E) can be adjusted, and thus the production of sound having an unintended frequency from protective sheet 5 (5A to 5E) can be reduced.

Furthermore, in push switch 1 (1A to 1E) according to the present disclosure, protective sheet 5 (5A to 5E) and rib 54 (54A to 54E) may be integrally formed.

Furthermore, in push switch 1 (1A to 1E) according to the present disclosure, rib 54 (54A to 54E) is provided on intermediate portion 53 (53A to 53E) of protective sheet 5 (5A to 5E).

With this configuration, it is possible to reduce the spring constant by partially increasing the rigidity of intermediate portion 53 (53A to 53E) of protective sheet 5 (5A to 5E) in an area where rib 54 (54A to 54E) is attached. Therefore, by changing the position, number, size, shape, material, etc., of ribs 54 (54A to 54E), the natural frequency of protective sheet 5 (5A to 5E) can be adjusted, and thus the production of sound having an unintended frequency from protective sheet 5 (5A to 5E) and rib 54 (54A to 54E) can be reduced.

Note that in push switch 1 according to the present disclosure, in the case where rib 54 (54A to 54E) and protective sheet 5 (5A to 5E) are not integrally formed, it is possible to easily change the position of rib 54 (54A to 54E) by merely changing a position at which rib 54 (54A to 54E) is attached to protective sheet 5 (5A to 5E), as compared to the case where rib 54 (54A to 54E) and protective sheet 5 (5A to 5E) are integrally formed.

For example, in push switch 1 according to the present disclosure, the plurality of ribs 54 include first rib set 552 including two ribs 54*a*, 54*c* arranged adjacent to each other with spacing therebetween on first virtual circle 91*a* centered on pressing portion 52 as viewed in the first direction (from above) (refer to FIG. 3).

For example, in push switch 1 according to the present disclosure, spacing I between two ribs 54*a*, 54*c* of first rib set 552 along the circumferential direction of first virtual circle 91*a* is less than or equal to maximum length L2 of pressing portion 52 as viewed in the first direction (from above) (refer to FIG. 3).

For example, in push switch 1 according to the present disclosure, the plurality of ribs 54 include second rib set 551 including two ribs 54*a*, 54*b* arranged with spacing therebetween in an outward direction from pressing portion 52 as viewed in the first direction (from above) (refer to FIG. 3).

For example, in push switch 1 according to the present disclosure, one of two ribs 54*a*, 54*b* of second rib set 551, that is, rib 54*a*, extends along first virtual circle 91*a*, and the other of two ribs 54*a*, 54*b* of second rib set 551, that is, rib 54*b*, extends along second virtual circle 91*b* concentric with first virtual circle 91*a* and having a diameter greater than the diameter of first virtual circle 91*a* (refer to FIG. 3).

For example, in push switch 1A according to the present disclosure, each of at least two ribs 54A of rib set 55A extends perpendicularly with respect to the outward direction from pressing portion 52 (refer to FIG. 8).

For example, in push switch 1 according to the present disclosure, two ribs 54*a*, 54*b* of second rib set 551 have different lengths as viewed in the first direction (from above) (refer to FIG. 3).

For example, in push switch 1B according to the present disclosure, at least two ribs 54B of rib set 55B have an identical length as viewed in the first direction (from above) (refer to FIG. 9).

For example, in push switch 1C according to the present disclosure, among two ribs 54C of rib set 55C, rib 54C distant from pressing portion 52 is shorter than rib 54C proximal to pressing portion 52 as viewed in the first direction (from above) (refer to FIG. 11).

For example, in push switch 1B according to the present disclosure, protective sheet 5B is a quadrate sheet as viewed in the first direction (from above), pressing portion 52 is located in a central area of protective sheet 5B, fixed portion 51 is located in an outer peripheral area of protective sheet 5B, and rib 54B is located on diagonal 92 of protective sheet 5B having a quadrate shape as viewed in the first direction (from above) (refer to FIG. 9).

For example, in push switch 1A according to the present disclosure, protective sheet 5A is a quadrate sheet as viewed in the first direction (from above), pressing portion 52 is located in a central area of protective sheet 5A, fixed portion 51 is located in an outer peripheral area of protective sheet 5A, and rib 54A is located on virtual straight line 93 extending from pressing portion 52 perpendicularly with respect to a side of protective sheet 5A as viewed in the first direction (from above) (refer to FIG. 8).

In push switch 1 (1A to 1E) according to the present disclosure, rib 54 (54A to 54E) is located on the inner side of an inner peripheral surface of recess 21 as viewed in the first direction (from above).

In push switch 1 (1A to 1E) according to the present disclosure, pressing portion 52 is a portion to be pressed by pressing element 90, and rib 54 (54A to 54E) is located on the outer side of pressing element 90 as viewed in the first direction (from above) (refer to FIG. 3).

REFERENCE MARKS IN THE DRAWINGS

1, 1A-1E push switch
2 case
20 bottom
21 recess
213 pedestal
22 peripheral wall
220 fixing surface
221 groove
222 wall
223 wall
3 movable member
31 pressure-receiving portion (second pressure-receiving portion)
33 hole
4 movable contact member
40 touching piece
42 movable contact
431 pressure-receiving portion (first pressure-receiving portion)
44 supporting frame
5, 5A-5E protective sheet
51 fixed portion
52 pressing portion
53, 53A-53E intermediate portion
54, 54A-54E rib
55A-55E rib set
551 rib set (second rib set)
552 rib set (first rib set)
6 fixed contact member
60 embedded portion
611 fixed contact (first fixed contact)
612 terminal portion (first terminal portion)
7 terminal
70 embedded portion
72 fixed contact (second fixed contact)
73 terminal portion (second terminal portion)
8 pressing body
90 pressing element
91, 91*a*, 91*b* virtual circle
92 diagonal
93 virtual straight line
D1, D1*a* radial direction
D2, D2*a* circumferential direction
I spacing
L1 the length of the rib
L2 the maximum length of the pressing portion Lmax maximum value Lmin minimum value

The invention claimed is:

1. A push switch, comprising:

a case configured to include a recess;

a fixed contact member configured to include a fixed contact disposed in the recess;

a movable contact member configured to include a movable contact disposed in the recess;

a protective sheet disposed in a first direction from the recess and configured to cover the recess; and a rib disposed on the protective sheet, wherein the protective sheet includes:

a pressing portion;

a fixed portion fixed to the case; and an intermediate portion located between the pressing portion and the fixed portion as viewed in the first direction, as the pressing portion of the protective sheet is pressed along the first direction, the movable contact member deforms by force received from the protective sheet, and the movable contact touches the fixed contact as a result of the deformation of the movable contact member, wherein:

the rib is one of a plurality of ribs, and the plurality of ribs include a first rib set including two ribs arranged adjacent to each other with spacing therebetween on a first virtual circle centered on the pressing portion as viewed in the first direction, and wherein the spacing between the two ribs of the first rib set along a circumferential direction of the first virtual circle is less than or equal to a maximum length of the pressing portion as viewed in the first direction.

2. The push switch according to claim 1, wherein the protective sheet and the rib are integrally formed.

3. The push switch according to claim 1, wherein the rib is provided on the intermediate portion of the protective sheet.

4. The push switch according to claim 1, wherein the protective sheet is a quadrate sheet as viewed in the first direction, the pressing portion is located in a central area of the protective sheet, the fixed portion is located in an outer peripheral area of the protective sheet, and the rib is located on a diagonal of the protective sheet having a quadrate shape as viewed in the first direction.

5. The push switch according to claim 1, wherein the protective sheet is a quadrate sheet as viewed in the first direction, the pressing portion is located in a central area of the protective sheet, the fixed portion is located in an outer peripheral area of the protective sheet, and the rib is located on a virtual straight line extending from the pressing portion perpendicularly with respect to a side of the protective sheet as viewed in the first direction.

6. The push switch according to claim 1, wherein the rib is located on an inner side of an inner peripheral surface of the recess as viewed in the first direction.

7. The push switch according to claim 1, wherein the pressing portion is a portion to be pressed by a pressing element, and the rib is located on an outer side of the pressing element as viewed in the first direction.

8. A push switch, comprising:

a case configured to include a recess;

a fixed contact member configured to include a fixed contact disposed in the recess;

a movable contact member configured to include a movable contact disposed in the recess;

a protective sheet disposed in a first direction from the recess and configured to cover the recess; and a rib disposed on the protective sheet, wherein the protective sheet includes:

a pressing portion;

a fixed portion fixed to the case; and an intermediate portion located between the pressing portion and the fixed portion as viewed in the first direction, as the pressing portion of the protective sheet is pressed along the first direction, the movable contact member deforms by force received from the protective sheet, and the movable contact touches the fixed contact as a result of the deformation of the movable contact member, wherein:

the rib is one of a plurality of ribs, and the plurality of ribs include a second rib set including two ribs arranged with spacing therebetween in an outward direction from the pressing portion as viewed in the first direction, and wherein:

one of the two ribs of the second rib set extends along a first virtual circle centered on the pressing portion as viewed in the first direction, and the other of the two ribs of the second rib set extends along a second virtual circle concentric with the first virtual circle and having a diameter greater than a diameter of the first virtual circle.

9. The push switch according to claim 8, wherein each of the two ribs of the second rib set extends perpendicularly with respect to the outward direction from the pressing portion.

10. The push switch according to claim 8, wherein the two ribs of the second rib set have an identical length as viewed in the first direction.

11. The push switch according to claim 8, wherein the protective sheet and the rib are integrally formed.

12. The push switch according to claim 8, wherein the rib is provided on the intermediate portion of the protective sheet.

13. The push switch according to claim 8, wherein the protective sheet is a quadrate sheet as viewed in the first direction, the pressing portion is located in a central area of the protective sheet, the fixed portion is located in an outer peripheral area of the protective sheet, and the rib is located on a diagonal of the protective sheet having a quadrate shape as viewed in the first direction.

14. The push switch according to claim 8, wherein the protective sheet is a quadrate sheet as viewed in the first direction, the pressing portion is located in a central area of the protective sheet, the fixed portion is located in an outer peripheral area of the protective sheet, and the rib is located on a virtual straight line extending from the pressing portion perpendicularly with respect to a side of the protective sheet as viewed in the first direction.

15. The push switch according to claim 8, wherein the rib is located on an inner side of an inner peripheral surface of the recess as viewed in the first direction.

16. The push switch according to claim 8, wherein the pressing portion is a portion to be pressed by a pressing element, and the rib is located on an outer side of the pressing element as viewed in the first direction.

17. A push switch, comprising:

a case configured to include a recess;

a fixed contact member configured to include a fixed contact disposed in the recess;

a movable contact member configured to include a movable contact disposed in the recess;

a protective sheet disposed in a first direction from the recess and configured to cover the recess; and a rib disposed on the protective sheet, wherein the protective sheet includes:

a pressing portion;

a fixed portion fixed to the case; and an intermediate portion located between the pressing portion and the fixed portion as viewed in the first direction, as the pressing portion of the protective sheet is pressed along the first direction, the movable contact member deforms by force received from the protective sheet, and the movable contact touches the fixed contact as a result of the deformation of the movable contact member, wherein:

the rib is one of a plurality of ribs, and the plurality of ribs include a second rib set including two ribs arranged with spacing therebetween in an outward direction from the pressing portion as viewed in the first direction, wherein the two ribs of the second rib set have different lengths as viewed in the first direction.

18. The push switch according to claim 17, wherein among the two ribs of the second rib set, a second rib distant from the pressing portion is shorter than a first rib proximal to the pressing portion as viewed in the first direction.

19. The push switch according to claim 17, wherein the protective sheet and the rib are integrally formed.

20. The push switch according to claim 17, wherein the rib is provided on the intermediate portion of the protective sheet.

* * * * *